US010850420B2

(12) United States Patent
Thienst et al.

(10) Patent No.: US 10,850,420 B2
(45) Date of Patent: Dec. 1, 2020

(54) CUTTING POST FOR MOUNTING ON A CUTTING APPARATUS AND CUTTING APPARATUS HAVING SUCH A CUTTING POST

(71) Applicant: Harro Hoefliger Verpackungsmaschinen GmbH, Allmersbach im Tal (DE)

(72) Inventors: Andreas Thienst, Allmersbach im Tal (DE); Matthias Bisswang, Korb (DE); Berthold Kern, Hafenlohr (DE)

(73) Assignee: Harro Hoefliger Verpackungsmaschinen GmbH, Allmersbach im Tal (DE)

( * ) Notice: Subject to any disclaimer, the term of this patent is extended or adjusted under 35 U.S.C. 154(b) by 0 days.

(21) Appl. No.: 16/360,845

(22) Filed: Mar. 21, 2019

(65) Prior Publication Data

US 2019/0299481 A1 Oct. 3, 2019

(30) Foreign Application Priority Data

Mar. 28, 2018 (EP) ..... 18164716

(51) Int. Cl.
*B26D 7/26* (2006.01)
*B26D 1/00* (2006.01)
(Continued)

(52) U.S. Cl.
CPC ..... *B26D 7/2614* (2013.01); *B26D 1/0006* (2013.01); *B26F 1/44* (2013.01);
(Continued)

(58) Field of Classification Search
CPC ..... Y10T 83/9457; Y10T 83/9488; Y10T 83/9461; Y10T 83/9473; Y10T 83/9478; Y10T 83/9297; Y10T 83/9275; Y10T 83/93; Y10T 83/9302; Y10T 83/9304; Y10T 83/9307; B26D 7/2614; B26D 7/2628; B26D 7/26; B26D 1/0006; B26D 2001/0033; B26D 2001/0053; B26D 2001/006; B26D 2007/2607;
(Continued)

(56) References Cited

U.S. PATENT DOCUMENTS 3,263,547 A 8/1966 Pfaff et al.
6,523,448 B1 * 2/2003 Chang ..... B26D 7/025 83/653

(Continued)

FOREIGN PATENT DOCUMENTS

EP 2842704 A1 3/2015
JP S5545483 U 3/1980

*Primary Examiner* — Phong H Nguyen
(74) *Attorney, Agent, or Firm* — Walter Ottesen, P.A.

(57) ABSTRACT

The invention is directed to a cutting post for mounting on a cutting apparatus and to the cutting apparatus. The cutting apparatus has at least one cutting blade and at least one cutting post. The cutting post includes at least one receptacle for the cutting blade and at least one cutting element having a cutting edge arranged at the head end of the cutting post. The cutting blade has a cutting blade edge and is held in the receptacle of the cutting post. The cutting blade edge of the cutting blade and the cutting edge of the cutting element of the cutting post conjointly form a continuous cutting contour.

15 Claims, 5 Drawing Sheets

(51) Int. Cl.
*B65B 61/06* (2006.01)
*B26F 1/44* (2006.01)

(52) U.S. Cl.
CPC ..... *B65B 61/06* (2013.01); *B26D 2001/006* (2013.01); *B26D 2001/0033* (2013.01); *B26D 2001/0053* (2013.01); *B26F 2001/4463* (2013.01); *B26F 2001/4481* (2013.01)

(58) Field of Classification Search
CPC ..... B26D 2007/2685; B26F 1/44; B26F 2001/4463; B26F 2001/4481; B65D 61/06
USPC ..... 76/107.8
See application file for complete search history.

(56) References Cited

U.S. PATENT DOCUMENTS

| | | | |
|---|---|---|---|
| 9,511,505 | B2 | 12/2016 | Ohnishi et al. |
| 2015/0059544 | A1 | 3/2015 | Ohnishi et al. |

* cited by examiner

CUTTING POST FOR MOUNTING ON A CUTTING APPARATUS AND CUTTING APPARATUS HAVING SUCH A CUTTING POST

CROSS REFERENCE TO RELATED APPLICATION

This application claims priority of European patent application no. 18 164 716.5, filed Mar. 28, 2018, the entire content of which is incorporated herein by reference.

FIELD OF THE INVENTION

The invention relates to a cutting post for mounting on a cutting apparatus and to a cutting apparatus having at least one cutting blade and having at least one such cutting post.

BACKGROUND OF THE INVENTION

Packaging machines are used for producing product packagings in order to form the packagings in multiple method steps from plastic film, to fill them with a product and, where applicable, then to seal them. In one of the last method steps of such a production process, the packagings are usually severed from a large film portion. Cutting devices are provided in the packaging machines for this purpose.

Such cutting devices comprise a cutting contour which predefines the geometry and size of the product packaging to be cut out. In particular, in the case of more complex or also angular cutting contours, an arrangement of multiple cutting blades is necessary in order to be able to replicate the cutting contour. In the arrangement of cutting blades in relation to one another, gaps are formed between the cutting blades on account of usual production tolerances. The interruptions in the cutting contour result in the packagings not being cut at the meeting points of the cutting blades, in particular at the corner regions of the cutting contour. Disadvantageously, unwanted threads are formed at the non-cut positions. Where applicable, the packagings even tear out at the corresponding points. Such flaws on the packagings lead to a high level of production waste and consequently cause high costs in the production.

Cutting devices are certainly also known in which the cutting blades are welded together to avoid the named disadvantages. The production of a welded cutting contour, however, is very expensive and cost-intensive. The maintenance of such a cutting device is also disadvantageous. If just one cutting blade is faulty, all cutting blades welded together have nevertheless to be replaced.

SUMMARY OF THE INVENTION

It is an object of the invention to provide a cutting apparatus which enables cutting blades to be mounted in a simple manner and at the same time packagings to be cut out precisely.

It is another object of the invention to provide a cutting apparatus which enables cutting blades to be mounted in a simple manner and at the same time packagings to be cut out precisely.

The cutting post according to the invention for mounting on a cutting apparatus includes at least one receiving means for a cutting blade and at least one cutting element with a cutting edge arranged at the head end thereof. The cutting post, along with at least one cutting blade, is a component part of the cutting apparatus according to the invention. The at least one cutting blade comprises a cutting blade edge and is held in the receiving means of the at least one cutting post. The cutting blade edge of the cutting blade and the cutting edge of the cutting element of the cutting post form a continuous cutting contour.

By means of the receiving means of the cutting post, the cutting blade is able to be arranged and held in a predefined position with respect to the cutting post. The cutting post and the cutting blade, in this case, are arranged with respect to one another such that the cutting edge of the cutting blade with the cutting edge of the cutting element of the cutting post form a continuous cutting contour. Gaps in the cutting contour, in particular between the cutting post and the cutting blade can be avoided in this case. As a result, packagings are able to be severed completely along the entire cutting contour of the cutting apparatus. Non-cut portions along the outline of the packaging which result in thread formation or even in the packaging edges being torn out, can be avoided as a result. In addition, intersections and junctions in a cutting contour can be realized without gaps. The cutting posts and cutting blades are interchangeable individually, which facilitates geometric adaptations, maintenance work and repair jobs in a considerable manner.

As a result of the receiving means provided on the cutting post, the cutting blade is able to be positioned on the cutting post in a simple manner. When mounting cutting posts and cutting blades on the cutting apparatus, a continuous cutting contour can be formed in a comparatively simple manner.

The receiving means for the cutting blade is realized in a preferred manner as a groove on a circumferential side of the cutting post which extends in the direction of the longitudinal axis of the cutting post. As a result of the groove in the cutting post, the cutting post can be pushed in the longitudinal direction of the cutting blade when being mounted onto the cutting blade. In this case, the cutting blade projects into the groove of the cutting post. The cutting blade is consequently fixed in a positive locking manner in the groove. The cutting post supports the cutting blade mounted in the groove against transverse forces which can occur, for example, during the cutting operation. In addition, the groove of the cutting post enables cutting blade and cutting post to be fitted together, as a result of which comparatively low mounting costs can be ensured.

In a preferred manner, the cutting post comprises multiple and in particular three or four receiving means for one cutting blade each. Advantageously, the cutting post additionally includes on the head end thereof cutting elements assigned to the respective receiving means with one cutting edge each. If multiple cutting blades and multiple cutting posts are connected together, the cutting posts preferably form the junctions of the formed cutting contours. Various cutting contours, which can be configured in various geometries and sizes, can be formed as a result of the arrangement of multiple cutting posts and cutting blades. If, for example, four receiving means for cutting blades, which are arranged at the same angular distance to one another, are provided on cutting posts, square and/or rectangular cutting contours can be formed. If, for example, just three receiving means are provided, the cutting blades can be arranged with respect to one another in a honeycombed structure. As the cutting posts as junctions connect the cutting blade edges of the various cutting blades by means of the cutting edges of the cutting posts to form a continuous cutting contour, precise cutting out of packagings can be ensured even in the case of such complex structures.

A cutting tip, which tapers in a preferred manner in the direction of the foot end to the head end, is realized on the head end of the cutting post. The cutting tip is preferably formed by the cutting edge of the at least one cutting element. In this case, the cutting edge ends in the cutting tip. The cutting edge of the at least one cutting element preferably encloses an angle with a straight line which runs parallel to the longitudinal axis of the cutting post. The angle is open toward the foot end of the cutting post and is less than 90°, in particular less than 60° and in particular is approximately 45°.

During the cutting operation, the packaging film is consequently contacted firstly by the cutting tip and only then followed by the rest of the cutting contour. As a result, the packaging film is pierced initially by the cutting tip and proceeding from there is cut out along the cutting contour. As a result of the film being pierced, the packaging is already able to be cut out at low cutting forces so that the packaging film is neither distorted nor over-stretched.

It is advantageously provided that the at least one cutting element of the cutting post extends beyond the receiving means for the cutting blade proceeding from the longitudinal axis of the cutting post in the radial direction. If the blade is held in the receiving means of the cutting post, the cutting element of the at least one cutting post and the cutting blade overlap. In the mounted state, the cutting post and the cutting blade contact one another in the overlap. On the one hand, the overlap acts as a positive locking hold-down device for the cutting blade such that the cutting post and the cutting blade are positioned precisely with respect to one another in the longitudinal direction of the cutting post. On the other hand, as a result, a seamless transfer between the cutting edge of the cutting post and the cutting blade edge of the cutting blade is ensured. The overlap between cutting post and cutting blade thus serves for fixing the cutting blade in the longitudinal direction with at the same time realizing a continuous cutting contour.

A further component part of the cutting apparatus is advantageously at least one corner post. The corner post comprises at least one groove for receiving a cutting blade, but no assigned cutting element. Such corner posts can receive in particular cutting blades which are provided as edge elements and can support them. A continuation of the cutting contour is not necessary on such edge regions. Consequently, it is sufficient to provide the comparatively cost-efficient corner posts with cutting elements.

The cutting apparatus preferably includes a base plate, wherein multiple cutting blades and multiple cutting posts are fastened on the base plate in a modular manner so as to be releasable and interchangeable. As a result of the modular set up of the cutting contour produced by cutting blades and cutting posts, individual cutting contours can be created from the same basic elements and where applicable also modified. If a cutting blade or a cutting post has to be maintained or is even faulty, it is sufficient simply to replace the relevant element of the cutting apparatus for an intact element. It is not necessary to change the entire cutting apparatus. In addition, for example after a cutting apparatus has been shut down, the cutting blades and cutting posts thereof are able to be re-used in another cutting apparatus.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
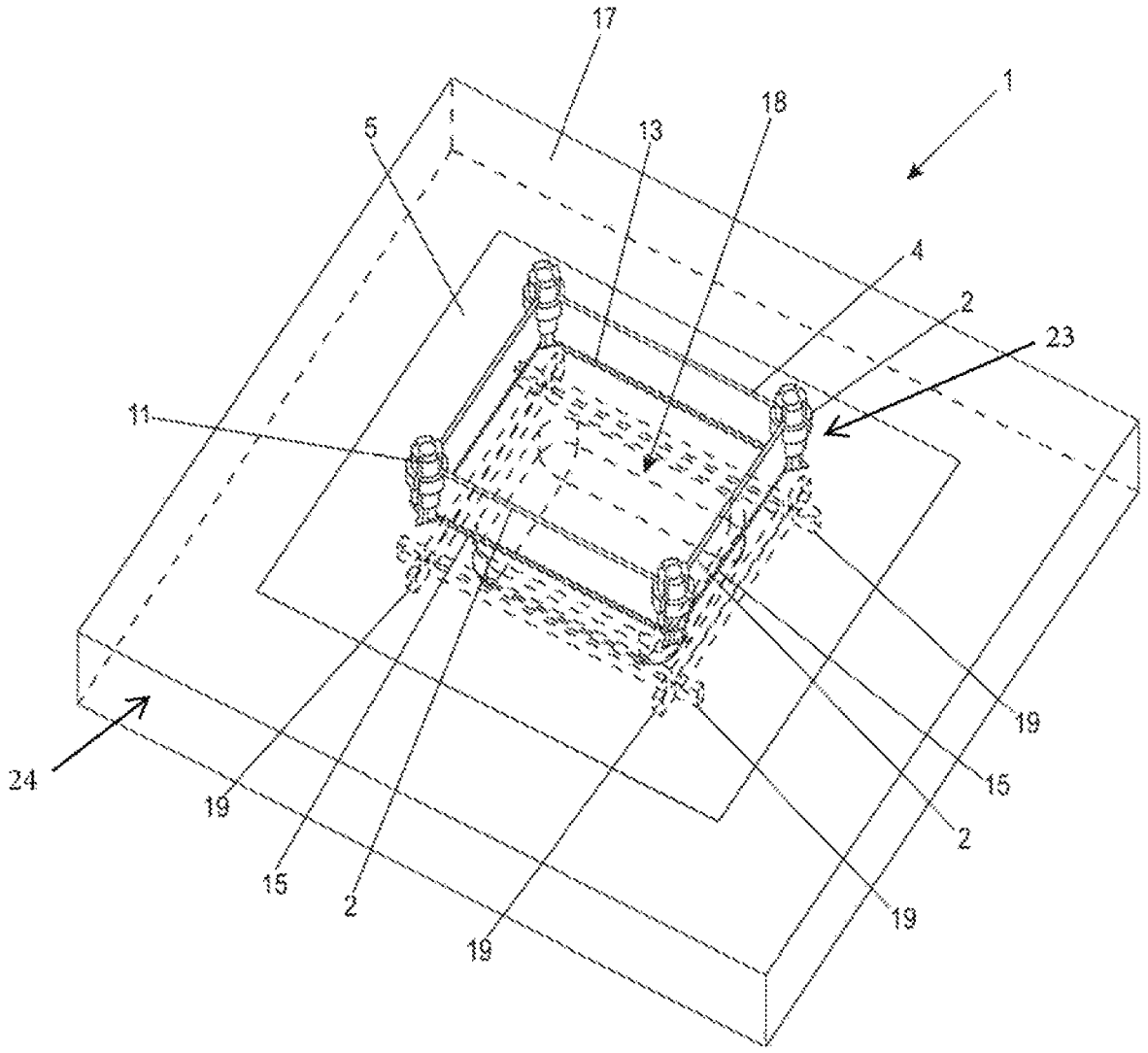
FIG. 1 shows a perspective representation of a cutting apparatus according to the invention with cutting blades and with cutting posts.

FIG. 1 shows a perspective view of a cutting apparatus realized according to the invention. The cutting apparatus 1 is part of a packaging machine (not shown) and serves herein for severing packagings. Such packagings are produced from plastic film which is usually provided in the form of film webs. The plastic film is deep-drawn in the packaging machine, for example by a deep-drawing method by means of vacuum, into a corresponding packaging form, for example into a bag form. The packaging form is then filled with the product to be packed and sealed with a second plastic film.

One of the last method steps, namely the severing of the filled packaging from the film web, is carried out by the cutting apparatus 1. Water-soluble plastics materials, such as polyvinyl alcohol (PVOH), are suitable in particular as packaging materials, but it is also possible to use insoluble plastics materials to produce such packagings. The packagings can be used, for example, for cleaning or washing agents both in powdery and liquid form. Such packagings are also suitable for use in the pharmaceutical field for packaging medicinal products.

Figure 5:
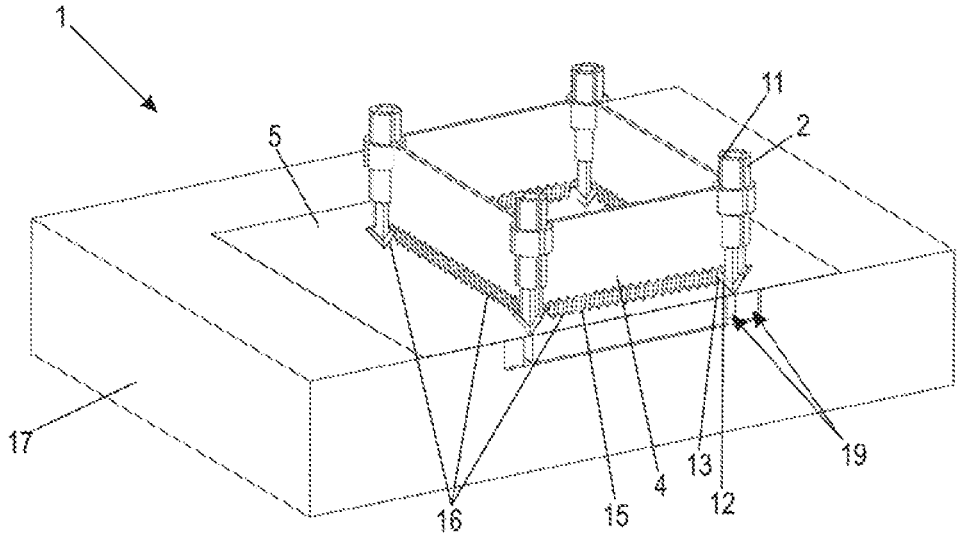
FIG. 5 shows a perspective, schematic sectional representation of the cutting apparatus according to FIG. 1 prior to contact with the film to be cut.

The cutting apparatus 1 comprises an upper part 23 and a lower part 24. In the embodiment shown in FIG. 1, the upper part 23 includes four cutting posts 2 and four cutting blades 4. The cutting posts 2 and the cutting blades 4 are mounted on a base plate (not shown). Receiving means 11, at which the cutting blades 4 are held in a positive locking manner, are realized on the cutting posts 2. One cutting blade edge 15 is realized on each of the cutting blades 4. The cutting posts 2 include cutting elements 12, on each of which a cutting edge 13 is integrally formed (FIG. 5). The cutting edges 13 of the cutting posts 2 and the cutting blade edges 15 of the cutting blades 4 form a continuous cutting contour 16. In the embodiment according to FIG. 1, the cutting blades 4 and the cutting posts 2 are arranged alternatingly with respect to one another in such a manner that the cutting contour 16 comprises a rectangular form.

The lower part 24 includes a molding plate 17 which comprises a trough 18. The trough 18 serves for molding the packaging in one of the upstream process steps of the packaging plant. A corresponding packaging is shown schematically as packaging film 5 in FIG. 1. Cutting slots 19, which are arranged in a rectangle extending around the trough 18 corresponding to the rectangular form of the cutting contour 16, are realized in the molding plate 17.

In order to cut the packaging film 5 to size corresponding to the cutting contour 16 of the upper part 23, lower part 24 and upper part 23 are moved together. In this case, the upper part 23 with the cutting contour 16 thereof is plunged into the cutting slot 19 of the lower part 24 and cuts through the packaging film 5. Once the packaging film 5 has been cut to size, upper part 23 and lower part 24 are moved apart again. The cutting posts 2 and the cutting blades 4 are pulled out of the cutting slots 19 of the lower part 24.

Figure 2:
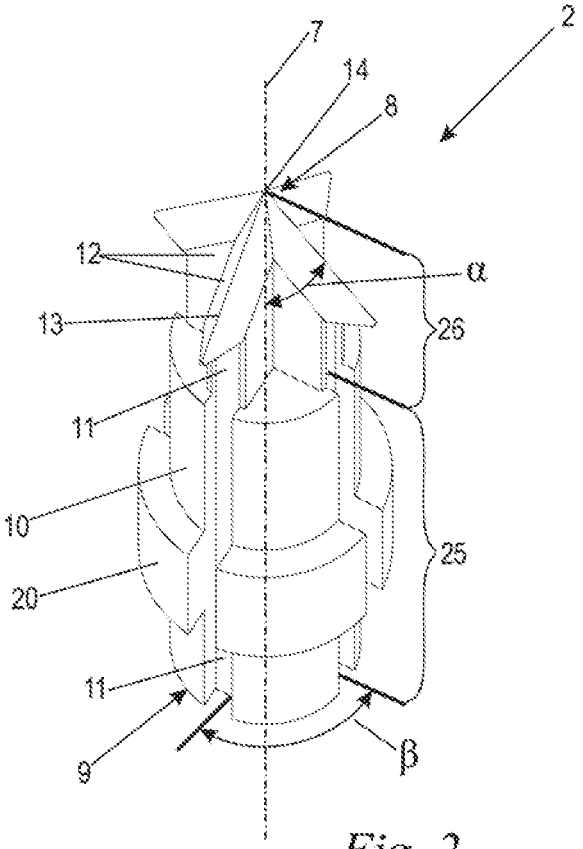
FIG. 2 shows a perspective representation of a cutting post according to the invention according to FIG. 1 with details regarding the geometric configuration thereof.
Figure 3:
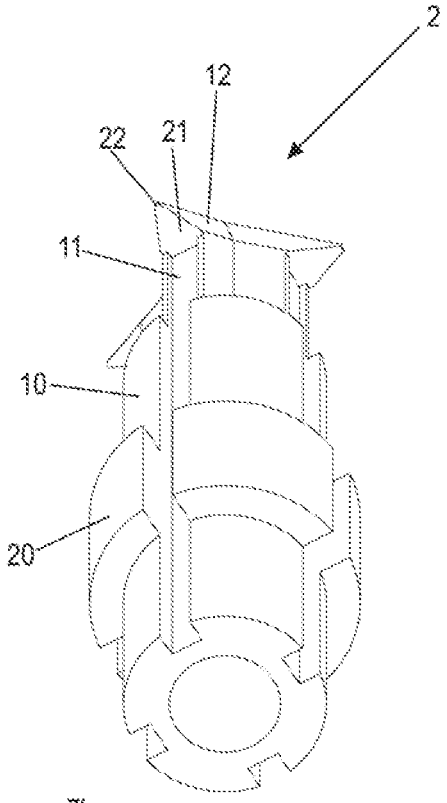
FIG. 3 shows a perspective representation from below of the cutting post according to FIG. 2.

FIGS. 2 and 3 show the cutting post 2, which is realized according to the invention, from FIG. 1. The cutting post 2 extends along the longitudinal axis 7 thereof from the foot end 9 thereof to the head end 8 thereof.

The cutting post 2 has a first portion 25 and a second portion 26. The cutting post 2 is realized along the first portion 25, which extends from the foot end 9 to the second portion 26, as a substantially cylindrical rotation body. Along the second portion 26, which extends from the first portion 25 to the head end 8, the cutting post 2 is formed from four plate-shaped cutting elements 12 each with one cutting edge 13. The cutting elements 12 are arranged with respect to one another in such a manner that the cutting edges 13 thereof taper together in the longitudinal axis 7.

The cutting edges 13 of the cutting elements 12 are angled in relation to the longitudinal axis 7 and end together in a cutting tip 14. The cutting edges 13 enclose an angle $\alpha$, which is open toward the foot end 9 of the cutting post 2, with the longitudinal axis 7 of the cutting post 2. The angle $\alpha$ is smaller than 90°, in particular smaller than 60°, in the preferred embodiment is approximately 45°.

As shown in FIGS. 2 and 3, the cutting post 2 comprises a circumferential side 10, on which four receiving means 11 for mounting the cutting blades 4 are realized. In the preferred embodiment, the receiving means 11 are realized as grooves which extend in the direction of the longitudinal axis 7. In this case, the grooves extend from the foot end 9 of the cutting post 2 to the cutting element 12. The groove is delimited by a first contact surface 21 which is realized on the side of the cutting element 12 facing the foot end 9. When mounting the cutting post 2 onto the cutting blade 4, the cutting post 2 can be pushed onto the cutting blade 4 at the groove thereof until the cutting post 2 comes to abut against the cutting blade 4 with the first contact surface 21 thereof. The first contact surface 21 accordingly forms a vertical stop between the cutting post 2 and the cutting blade 4 in the direction of the longitudinal axis 7. A second contact surface 22, which serves as a horizontal stop between the cutting post 2 and the cutting blade 4 proceeding from the longitudinal axis 7 in the radial direction, is additionally realized on the cutting element.

The four receiving means 11 are arranged at regular angular distances in the circumferential direction of the cutting post 2. Consequently, the angular distance $\beta$ between each two mutually adjacent receiving means 11 of the cutting posts shown in FIGS. 2 and 3 is 90°. The cutting elements 12 are aligned at the same angular distances as the receiving means 11 so that each two mutually adjacent cutting elements 12 with the cutting edges 13 are at an angular distance $\beta$ from one another amounting to 90°.

As a result, the cutting posts 2 in arrangement with the cutting blades 4 mounted on the base plate form a rectangular structure. In an alternative realization variant of the cutting apparatus 1 (not shown), the angular distance $\beta$ of adjacent receiving means 11 and adjacent cutting elements 12 with regard to one another can be different. As a result, for example, diamond or parallelogram shapes or other structures can be created.

Figure 4:
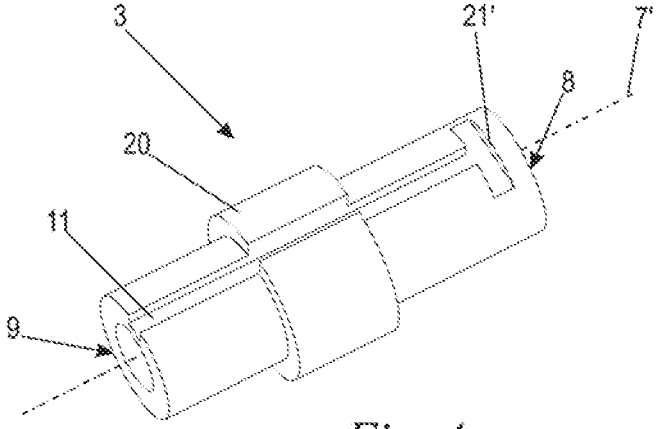
FIG. 4 shows a perspective representation of a variant of the cutting post according to the preceding figures realized as a corner post, but without cutting edges.

FIG. 4 shows a corner post 3. The corner post 3 comprises a receiving means 11 which is realized as a groove in the embodiment. The groove extends, as in the case of the cutting post 2, along the longitudinal axis 7' of the corner post 3. In this case, the groove extends from the foot end 9 to a first contact surface 21' which is realized on the head end 8 of the corner post 3. The corner post, just as the cutting post 2, can also be pushed onto the cutting blade 4 by way of the groove 11 thereof for mounting until it comes to abut against the first contact surface 21'. The corner posts do not comprise any cutting elements 12. The corner posts 3 simply serve as support for the cutting blades 4 which are arranged at edge regions of a cutting pattern.

Figure 6:
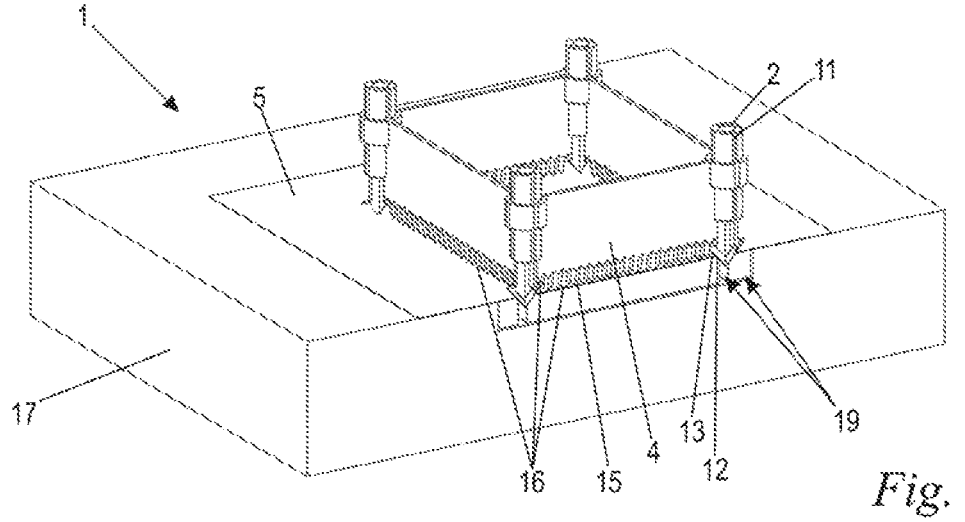
FIG. 6 shows the apparatus according to FIG. 5 with cutting tips of the cutting posts piercing the film.
Figure 7:
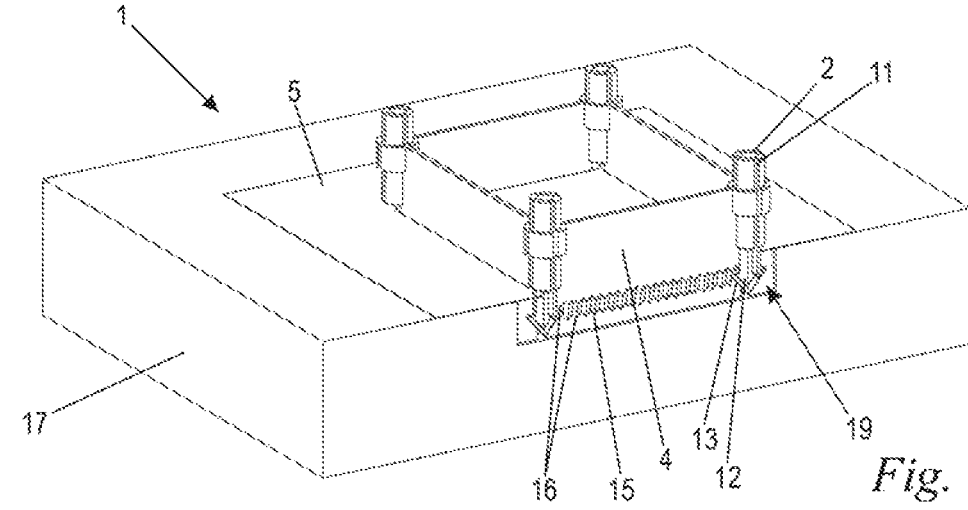
FIG. 7 shows the apparatus according to FIGS. 5 and 6 with the cutting blades sunk further cutting through the film.

FIGS. 5 to 7 show schematic sectional representations of the cutting apparatus according to FIG. 1 which illustrate the cutting operation in steps. In FIG. 5, the upper part and the lower part are still situated in the initial position. In FIG. 6, the upper part and lower part have already moved together by such a distance that the cutting tips 14 pierce the packaging film 5. The cutting post 2 is inserted with the second portion 26 thereof, namely with the cutting elements 12 thereof, into the cutting slot 19. The packaging film 5 is then cut into by the cutting edges 13. The cutting blade edges 15 of the cutting elements 4 do not yet project into the cutting slot 19. The upper part 23 and the lower part 24 are not moved together completely until FIG. 7. The cutting blades 4 are inserted into the cutting slot 19 and the packaging film 5 is cut out. The upper part and the lower part are then moved apart from one another again.

In the embodiment according to the cutting apparatus according to FIG. 1, the cutting blade edges 15 comprise a fluting or a serrated edge which extends exclusively in the plane of the respective cutting blade, that is, does not have a wave shape transversely thereto. As a result, the cutting forces on the packaging film 5 can be reduced so that stretching or distortion of the packaging film 5 is avoided. At the same time, the cutting lines and consequently the outlines of the cut-out packaging are realized in straight lines.

Figure 8:
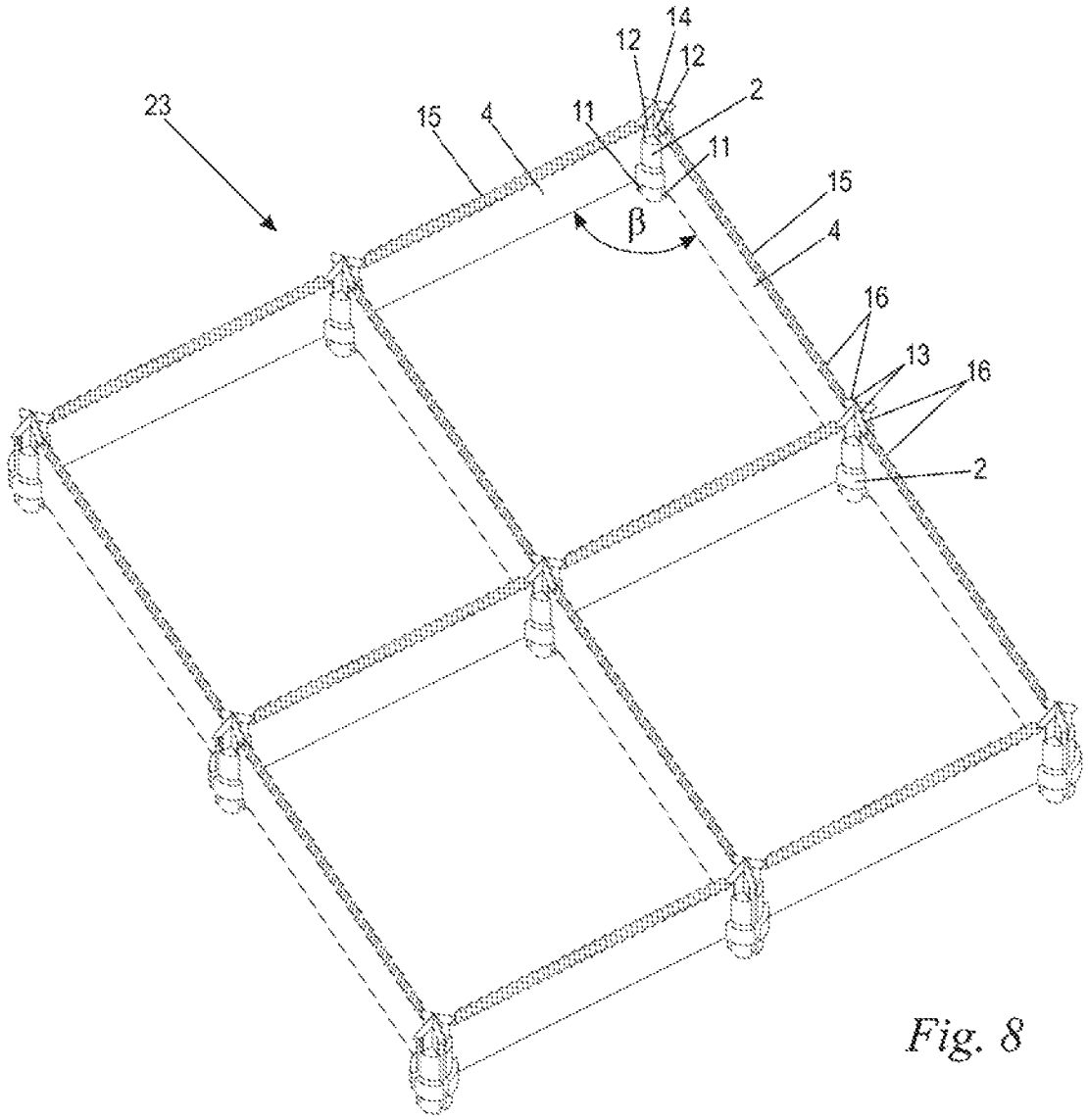
FIG. 8 shows a perspective representation of a realization variant of the apparatus according to FIGS. 1 to 7 with a cutting contour in a multiple rectangular structure; and, FIG. 9 shows a perspective representation of a further realization variant with a cutting contour in a honeycomb structure and with corner posts according to FIG. 4.

FIG. 8 shows an apparatus produced from multiple cutting posts 2 and multiple cutting blades 4 as a variant of the apparatus according to FIG. 1 with a rectangular cutting contour 16 which is repeated multiple times. In accordance with FIGS. 2, 3, the cutting posts 2 comprise in each case four receiving means 11 and four cutting elements 12. The receiving means 11 adjacent one another and the cutting elements 12 adjacent one another are each at an angular distance $\beta$ of 90°. This determines a square, at least rectangular arrangement of cutting posts 2 and of cutting blades 4.

Figure 9:
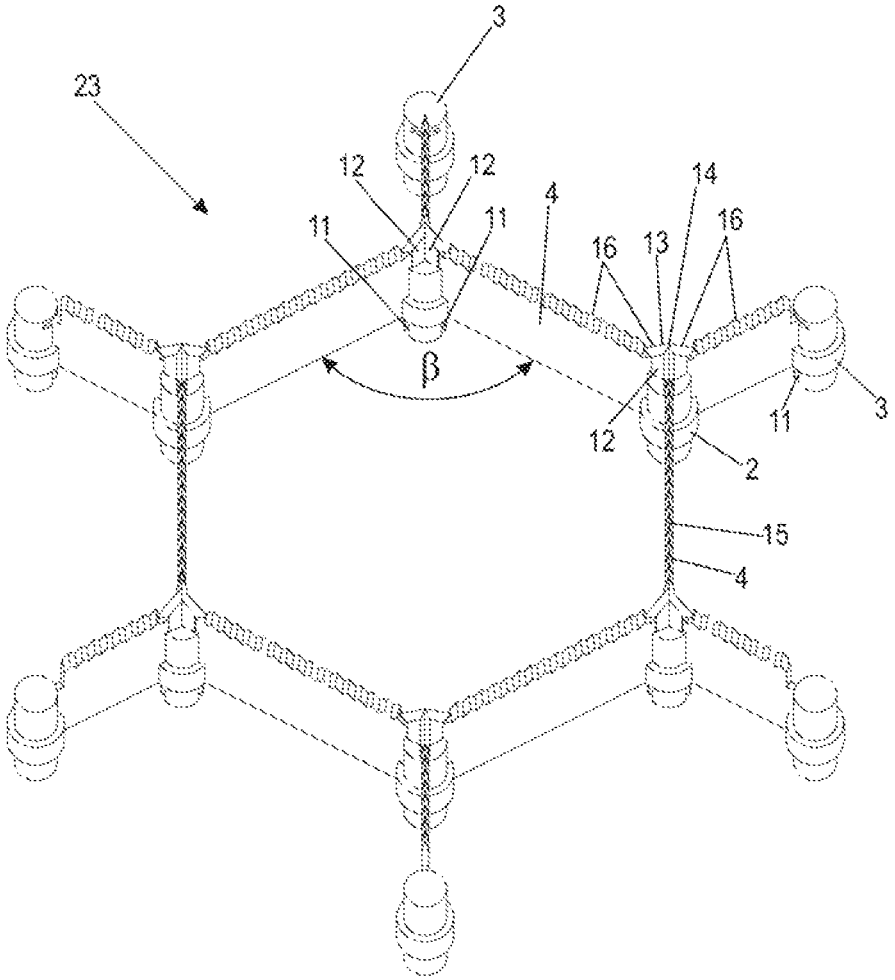

FIG. 9 shows a further embodiment of an arrangement of multiple cutting posts 2 and multiple cutting blades 4, here in addition also multiple corner posts 3 being used. The cutting posts 2 comprise here in each case three receiving means 11 and three cutting elements 12. The receiving means 11 adjacent to one another and the cutting elements 12 adjacent to one another are each at an angular distance $\beta$ of 120°. This results in a honeycomb-shaped arrangement of the cutting posts 2 and of the cutting blades 4 and a correspondingly honeycomb-shaped cutting pattern. The cutting blades 4 are held at corner posts 3 at the edge regions of the arrangement.

The cutting patterns according to FIGS. 8 and 9 can be extended or even reduced at will by attaching additional cutting blades 4, cutting posts 2 and corner posts 3 in a modular manner. The cutting posts 2 serve as connecting elements of the cutting blades 4. In addition to the embodiment according to FIG. 2, the cutting posts here not only exercise the function as corner posts but also the function as junctions or intersection points for the individual cutting lines. In this case, as a result of the connection of multiple cutting blade edges 15 to one another via the cutting edges 13 of the cutting elements 12, the cutting posts 2 ensure a cutting contour 16 which is continuous and gap-free overall.

It is understood that the foregoing description is that of the preferred embodiments of the invention and that various changes and modifications may be made thereto without departing from the spirit and scope of the invention as defined in the appended claims.

What is claimed is:

1. A cutting post for mounting on a cutting apparatus, said cutting post defining a longitudinal axis and comprising:

a head end and a foot end;

said cutting post having at least one receptacle for receiving a cutting blade therein;

at least one cutting element arranged on said head end;

said cutting element having a cutting edge;

a cutting tip tapering in a direction from said foot end toward said head end and being configured on said head end; and, wherein said at least one cutting element, proceeding from said longitudinal axis, extends in radial direction beyond said receptacle.

2. A cutting post for mounting on a cutting apparatus, said cutting post defining a longitudinal axis and comprising:

a head end and a foot end;

said cutting post having at least one receptacle for receiving a cutting blade therein;

at least one cutting element arranged on said head end;

said cutting element having a cutting edge;

a cutting tip tapering in a direction from said foot end toward said head end and being configured on said head end; and, wherein said cutting edge of said at least one cutting element and a straight line running parallel to said longitudinal axis conjointly define an angle ($\alpha$) open toward said foot end; and, said angle ($\alpha$) is less than 90°.

3. The cutting post of claim 2, wherein said cutting post has a peripheral side and said receptacle is configured as a groove in said peripheral side; and, said groove runs in the direction of said longitudinal axis.

4. The cutting post of claim 2, wherein said cutting post further comprises: a plurality of said receptacles configured for receiving respective cutting blades therein; a plurality of said cutting elements on said head end assigned to corresponding ones of said receptacles; and, said cutting elements having respective ones of said cutting edge.

5. The cutting post of claim 4, wherein said plurality of said receptacles is three in number.

6. The cutting post of claim 4, wherein said plurality of said receptacles is four in number.

7. The cutting post of claim 2, wherein said cutting edge of said at least one cutting element runs to said cutting tip.

8. The cutting post of claim 2, wherein said angle ($\alpha$) is less than 60°.

9. The cutting post of claim 2, wherein said angle ($\alpha$) is approximately 45°.

10. A cutting apparatus comprising:

at least one cutting post defining a longitudinal axis;

said cutting post having a head end and a foot end;

said cutting post having at least one cutting element arranged on said head end;

said cutting element having a cutting edge;

a cutting tip tapering in a direction from said foot end toward said head end and being configured on said head end;

at least one cutting blade having a cutting blade edge;

said cutting post having a receptacle for receiving and holding said cutting blade therein;

said cutting blade edge of said cutting blade and said cutting edge of said cutting element conjointly defining a continuous cutting contour; and, wherein said cutting edge of said at least one cutting element and a straight line running parallel to said longitudinal axis conjointly define an angle ($\alpha$) open toward said foot end; and, said angle ($\alpha$) is less than 90°.

11. The cutting apparatus of claim 10, wherein said receptacle is configured as a groove; and, said at least one cutting blade projects into said groove.

12. The cutting apparatus of claim 10, wherein said cutting element of said at least one cutting post and said cutting blade mutually overlap.

13. The cutting apparatus of claim 10, further comprising a corner cutting post having at least one groove for receiving a cutting blade therein; and, said corner cutting post having a head end without an assigned cutting element.

14. The cutting apparatus of claim 10, further comprising a plurality of said cutting posts and a plurality of said cutting blades; and, said plurality of cutting posts and said plurality of cutting blades being interconnected so as to cause said cutting posts to define respective junctions of cutting contours.

15. The cutting apparatus of claim 10, further comprising a base plate configured so as to permit a plurality of said cutting blades and a plurality of said cutting posts to be fastened on said base plate in a modular manner so as to be releasable and interchangeable.

* * * * *